US010152847B2

(12) United States Patent
Nizgoda

(10) Patent No.: US 10,152,847 B2
(45) **Date of Patent: *Dec. 11, 2018**

(54) SYSTEM, METHOD, AND DEVICE FOR CONDUCTING A WAGERING GAME

(71) Applicant: AGS LLC, Las Vegas, NV (US)

(72) Inventor: David Nizgoda, Las Vegas, NV (US)

(73) Assignee: AGS LLC, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/845,030

(22) Filed: Dec. 18, 2017

(65) Prior Publication Data

US 2018/0108214 A1 Apr. 19, 2018

Related U.S. Application Data

(63) Continuation of application No. 14/569,283, filed on Dec. 12, 2014, now Pat. No. 9,858,757.

(60) Provisional application No. 62/070,434, filed on Aug. 26, 2014.

(51) Int. Cl.

| | |
|---|---|
| ***A63F 9/24*** | (2006.01) |
| ***G07F 17/32*** | (2006.01) |
| ***A63F 1/06*** | (2006.01) |
| ***A63F 1/18*** | (2006.01) |
| *A63F 3/00* | (2006.01) |

(52) U.S. Cl.

CPC ..... *G07F 17/3244* (2013.01); *A63F 1/067* (2013.01); *A63F 1/18* (2013.01); *G07F 17/326* (2013.01); *A63F 2003/00164* (2013.01); *G07F 17/3293* (2013.01)

(58) Field of Classification Search

None

See application file for complete search history.

(56) References Cited

U.S. PATENT DOCUMENTS

| | | | | |
|---|---|---|---|---|
| 4,836,553 | A | 6/1989 | Suttle et al. | |
| 5,364,104 | A * | 11/1994 | Jones | A63F 1/00 273/292 |
| 5,417,430 | A | 5/1995 | Breeding | |
| 5,803,460 | A | 9/1998 | Hesse | |
| 6,237,916 | B1 | 5/2001 | Webb | |
| 8,177,619 | B2 | 5/2012 | Jackson | |
| 9,858,757 | B2 * | 1/2018 | Nizgoda | G07F 17/3244 |
| 2006/0131809 | A1 | 6/2006 | Lancaster | |
| 2008/0026851 | A1 | 1/2008 | Goetsh | |
| 2009/0104963 | A1 | 4/2009 | Burman | |
| 2010/0203940 | A1 | 8/2010 | Alderucci | |

(Continued)

OTHER PUBLICATIONS

International Search Report and Written Opinion for Application No. PCT/US2015/46736; 14 pages; dated Nov. 30, 2015.

*Primary Examiner* — Paul A D'Agostino

(74) *Attorney, Agent, or Firm* — Weide & Miller, Ltd.

(57) ABSTRACT

A method and device for conducting a wagering game includes receiving an ante wager. A player hand of game pieces is dealt and a final player hand is formed by selecting the game pieces with matching rank indicia from the player hand. The final player hand is evaluated by comparing the final player hand to a standard, such as a pay table, a final dealer hand, and/or final player hands of other players. Payouts are issued if the final player hand is a winning hand based on the evaluation. Optionally, side wagers may be offered on the constitution of the final player hand.

18 Claims, 3 Drawing Sheets

(56) References Cited

U.S. PATENT DOCUMENTS

| | | | | |
|---|---|---|---|---|
| 2013/0217456 | A1 | 8/2013 | Jaffa et al. | |
| 2014/0087801 | A1 | 3/2014 | Nicely | |
| 2014/0087806 | A1 | 3/2014 | Snow | |
| 2014/0094235 | A1 | 4/2014 | Ventura | |
| 2016/0063812 | A1* | 3/2016 | Nizgoda ..... | G07F 17/3244 463/25 |

* cited by examiner

SYSTEM, METHOD, AND DEVICE FOR CONDUCTING A WAGERING GAME

RELATED APPLICATION DATA

This application is a continuation of U.S. patent application Ser. No. 14/569,283, filed Dec. 12, 2014, which claims the priority of U.S. Provisional Patent Application Ser. No. 62/070,434, filed Aug. 26, 2014. The present application claims priority to each of said applications and incorporates by reference each of said applications as if set forth fully herein.

FIELD OF THE INVENTION

The present invention relates to wagering games. More specifically, the present invention includes a system, method, and computer device for conducting a wagering game in which a player forms a hand of using only playing cards within a predefined subset of ranks.

BACKGROUND OF THE INVENTION

A number of theories exist as to the origin of the game of poker. It is said by some authorities that Poker originates from the ancient Persian game of As-nas. The modern form of poker with its innumerable, different forms can be traced to the European game of Primero which was played with four cards per person and the cards were ranked in a complicated points system. In England, Primero was overtaken in popularity by a game called Brag of which there were many forms: three-card, five-card, seven-card and nine-card versions, the most popular being the three-card stud version. Wild cards were often used in Brag and were known as Braggers.

In modern casinos the game of poker takes one of three forms: live or cardroom poker where players compete against one another and the House charges a levy either in the form of a participation fee or as a percentage of winning hands; electronic video machines offering various games of poker, in particular, five card draw poker; and poker played as a "banker's game" either where the game involves players in contest with the dealer's hand or where the object is for players to obtain a hand based on hierarchical poker rankings, or games which combine the above two objects.

Live or cardroom poker games commonly available include Texas Hold'Em, Omaha, and seven-card stud. These games require considerable skill and a relatively large bankroll to have any expectation of success. As a result, most novice players avoid cardroom games.

Casinos have attempted to address this concern by providing poker-style table games that are house-banked and that require little expertise. Typical examples of such games are Caribbean Stud™, U.S. Pat. No. 4,836,553 and Let It Ride™, U.S. Pat. No. 5,417,430. Both games are based on five-card stud. In Caribbean Stud™, for example, the players' hands are pitted against the dealer's hand. In Let It Ride™, the sole objective is to form a winning hand based on a set of odds and a hierarchy of poker hand rankings.

Another example of a house-banked poker game is Three Card Poker™, U.S. Pat. No. 6,237,916. In Three Card Poker™, each player may place an ante wager, a "pairs plus" wager, or both wagers. The ante wager is a bet on the player's hand against the dealer's hand and the "pairs plus" wager is a bet on the ranking of the player's hand against a schedule of winning hands. After examining his hand, the player may fold and forfeit his ante wager or continue play by placing a mandatory play wager equal to the ante wager. This is often referred to as a "bet or fold" decision. To be rewarded on both the ante and play wagers two conditions must be met: (1) the dealer must have a qualifying hand of a Queen high or better and (2) the player's hand must outrank the dealer's hand. If the dealer hand does not qualify, the player wins an even money award on the ante wager and the play wager is returned. If the dealer hand qualifies and outranks the player hand, the player loses both the ante wager and the play wager. If the player has made the "pairs plus" wager and his hand includes a winning hand based on a schedule of winning hands, he receives a payout listed on the schedule.

SUMMARY OF THE INVENTION

The present invention includes systems, methods, and devices for conducting a wagering game. In one optional embodiment, a method may be conducted at a live table, electronic table, video gaming machine, kiosk, handheld device, cellular telephone, tablet, personal computer, or in any other fashion. In an optional embodiment conducted using a device, a device may include a data processor in communication with a display, a player interface, and a data storage device.

A method may be conducted using physical game pieces or electronic representations thereof. In one optional embodiment, the game pieces are playing cards. The game pieces are marked with at least one rank indicium. For example, in an optional embodiment in which the game pieces are playing cards, the playing cards may be marked with ranks of 2, 3, 4, 5, 6, 7, 8, 9, 10, Jack, Queen, King, and Ace. In an optional embodiment conducted using a device, electronic representations of game pieces may be stored at a data storage device.

A subset of rank indicia is defined for collection. In one optional embodiment, the subset may include the ranks Jack, Queen, King, and Ace. It is contemplated that the collection subset may be defined to include any ranks. For example, in an alternate optional embodiment, the subset may include the ranks 10, Jack, Queen, King, and Ace.

An ante wager is received from each player. In an additional or alternative embodiment, a side wager may also be received. In an optional embodiment in which a method is conducted using a device, the ante wager and optional side wager may be received through a player interface.

A player hand of game pieces is dealt in response to receipt of the ante wager. In an optional embodiment implemented using a device, a player hand may be dealt by the data processor and displayed at a display. In one example, the player hand includes seven game pieces, e.g., seven playing cards.

In an optional embodiment, an election may be received to either place a play wager to continue in the game or forfeit the ante wager and fold.

A final player hand is formed from each remaining player hand using only the game pieces in the player hand marked with rank indicia from the predefined subset. For example, in an optional embodiment in which the game pieces are playing cards marked with conventional poker rankings and the subset includes Jack, Queen, King, and Ace ranks, each final player hand may consist only of the playing cards in the player hand from the predefined subset of ranks, e.g., Ace cards and face cards. In an optional embodiment in which a method is conducted on a device, the data processor may form the final player hand and, optionally, display the final player hand at a display.

Each final player hand is evaluated based at least on the quantity of game pieces in the final player hand and a determination is made whether to issue a payout based on the evaluation. For example, in an optional embodiment in which the game pieces are playing cards, a hand ranking system may be devised based on the quantity of playing cards in the final player hand from the predefined subset of ranks. In the event that hands contain an equal quantity of playing cards, the individual ranks of the playing cards within the hands may be compared. In an optional embodiment in which a method is implemented on a device, a data processor may evaluate the final player hands and issue any pay outs based on the evaluation.

For example, in one optional embodiment, a dealer hand is dealt. A final dealer hand is formed from game pieces, e.g., playing cards, from the predefined subset of ranks. The final player hands are evaluated by comparing each final player hand to the final dealer hand. In an optional embodiment, the final dealer hand must have a qualifying ranking to proceed to the comparison step. If the final dealer hand fails to qualify, the comparison step may be omitted and the game terminated. For example, in one such optional embodiment, if the final dealer hand fails to qualify, the ante wager may be returned and the play wager may be paid. If the final dealer hand qualifies, but the final player hand outranks the final dealer hand, the player may be paid on both the ante wager and play wager. If the final dealer hand qualifies and outranks the final player hand, the ante wager and play wager may be collected.

In a further optional embodiment, the player hands may be compared to a pay table. In one such optional embodiment, a pay table may be defined with hand rankings and associated pay outs. The final player hands are compared to the hand rankings on the pay table and the pay out, if any, associated with the hand ranking of the final player hand is issued to the player. If the hand ranking of the final player hand does not appear on the pay table, the player's wager(s) may be collected. Such a pay table comparison may be utilized to resolve the base wagers (e.g., the ante wager and/or the play wager) or may be used to resolve a side wager separate from the base wagers.

For example, in an optional embodiment, an optional side wager may be offered. In one such optional embodiment, a side wager pay table of hand rankings and associated pay outs is defined. A side wager is received prior to dealing the player hand. The side wager is resolved by comparing the final player hand to the side wager pay table and issuing the pay out, if any, associated with the final player hand. In one such optional embodiment, the pay outs may include a progressive pay out.

DETAILED DESCRIPTION OF THE INVENTION

Reference is now made to the figures wherein like parts are referred to by like numerals throughout. The present invention is directed to a wagering game conducted using game pieces. The game pieces may take any form, including playing cards, tiles, dominoes, dice, or any other type of game piece. The game pieces are marked with at least one rank indicium. The rank indicia are divided into at least two groups.

For example, in one optional embodiment, the game pieces are playing cards. The playing cards may be conventional playing cards marked with a rank and a suit, with the ranks including deuce, three, four, five, six, seven, eight, nine, ten, Jack, Queen, King, and Ace and the suits including hearts, spades, diamonds, and clubs. Thus, in an embodiment of the game directed to using the rank indicia, a conventional fifty-two card poker deck of playing cards are marked with one of thirteen rank indicia.

Nevertheless, this should be interpreted as illustrative rather than limiting since a method according to the present invention may be conducted using a supplemented deck (a conventional poker deck including additional cards, such as Jokers), a truncated deck (a conventional poker deck excluding cards, such as a Spanish deck), or a modified deck (such as multiple poker decks, multiple supplemented decks, and/or multiple truncated decks) may be used. It is contemplated that the rank indicia may be separate from (or in addition to) the conventional poker ranking of a playing card. For example, in addition to being denoted with a conventional poker rank of deuce, three, four, five, six, seven, eight, nine, ten, Jack, Queen, King, or Ace, a playing card may include a secondary marking which serves as the rank indicium contemplated according to the present invention. Thus, the examples given below directed to the use of the conventional poker rank indicia should be interpreted as an illustration of an embodiment of the present invention rather than the entirety of the present invention.

Figure 1:
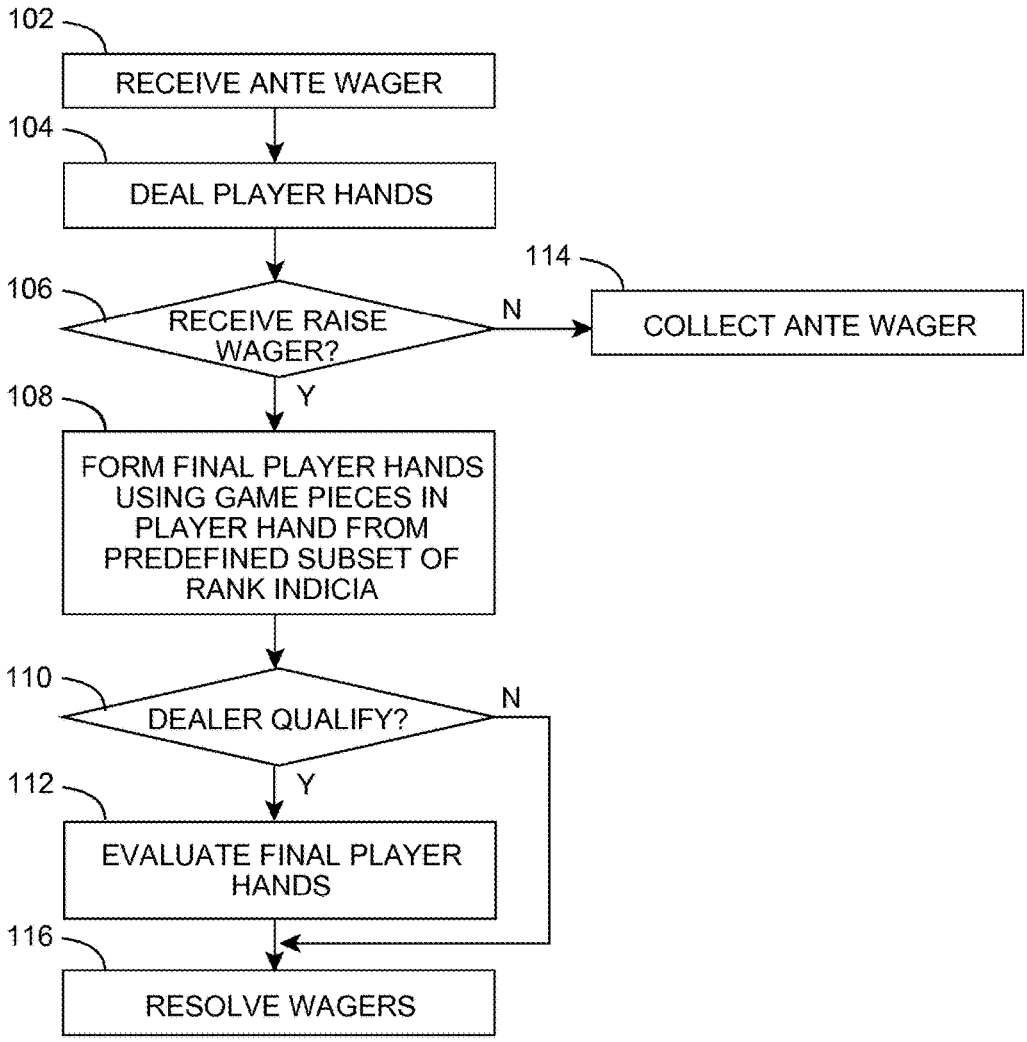
FIG. 1 is a flow chart of a method conducted according to an embodiment of the present invention.

In an optional embodiment illustrated in FIG. 1, an ante wager is received 102 from a player. In an optional embodiment, the ante wager is required for participation in the game. In an optional embodiment directed to a live table game, electronic table game, or the like, an ante wager may be placed using physical gaming chips, coins, currency, or the like. In an optional embodiment directed to an electronic device, the player may designate an ante wager using an input device or other player interface. The ante wager in an electronic game may be debited from a register of game credits stored by the electronic device.

In one optional embodiment, a player hand of game pieces is dealt 104 to each player who placed an ante wager. The quantity of game pieces making up a player hand may vary depending on the optional embodiment. For example, in an optional embodiment utilizing a single conventional deck of playing cards, a player hand of seven playing cards may be dealt in response to receipt of the ante wager.

In one optional embodiment, the game may proceed to forming 108 final player hands and resolving 116 the ante wagers. In another optional embodiment, one or more rounds of wagering may occur after the player hands have been dealt but before final player hands are formed.

In one such example, a decision may be received from each player to either place 106 a play wager or fold and forfeit 114 the player's ante wager. This decision, sometimes referred to as a "bet-or-fold" decision, may be required from all players, i.e., every player in the game must either place a play wager to continue in the game or fold and terminate his or her participation in the game. In an optional embodiment, the play wager may be capped at a maximum amount. For example, in one optional embodiment, the maximum amount of the play wager may be fixed at twice the ante wager, although this may vary in alternate optional embodiments.

In an alternate optional embodiment, play wagers may be optional to the player. Such a step is commonly referred to as a "bet-or-check" decision insofar as the player may, but is not required to, place a play wager.

A final player hand is formed 108 based on the player hand. In an optional embodiment in which play wagers are mandatory, a final player hand may be formed only for those player hands associated with a play wager. Player hands for which no play wager was received would be collected, and the game would be terminated as to those player hands.

In an optional embodiment, a final player hand is formed using only the game pieces in the player hand from a predefined subset of rank indicia. The game pieces that do not have matching rank indicia may be removed from the final player hand, e.g., discarded or otherwise removed from the final player hand, or may remain in the final player hand. In an optional embodiment conducted using a device, the final player hand may be formed by the player using the player interface or may be formed automatically by the data processor.

Depending on the optional embodiment, a hand ranking system may be defined to form final player hands and determine whether a final player hand is a winning hand. For example, in an optional embodiment using conventional playing cards marked with suit indicia and rank indicia, a hand ranking system may be based first on the quantity of playing cards from the predefined subset of rank indicia and second on the rank of the highest playing card from that predefined subset of rank indicia. Thus, in such an example, if a player hand consists of seven playing cards of Ace, King, Jack, nine, nine, five, deuce, the final player hand would consist of the three cards Ace, King, and Jack, i.e., the three cards of the predefined subset of ace playing cards and face playing cards.

As noted above, in an optional embodiment, the game pieces falling outside the predefined subset of rank indicia may remain in the final player hand. In one optional embodiment, the non-ace and non-face cards may remain in the final player hand, but are disregarded in determining the ranking of the final player hand. In another optional embodiment, the non-ace and non-face cards are discarded from the player hand and only the ace and face cards form the final player hand.

The final player hand is evaluated 112 to determine if the hand is a winning hand. As noted above, the hand ranking system may take any form. In one optional embodiment, hands are ranked first by the quantity of game pieces in a hand from the predefined subset of rank indicia. In such an optional embodiment, a hand with, for example, four ace and/or face cards always outranks a hand of three or fewer ace and/or face cards, without examining the specific cards making up the hands. In an additional or alternative embodiment, hands are ranked second by the individual ranking of the game pieces, if the quantity of game pieces in the two hands is equal. In such an optional embodiment, a hand with, for example, an Ace, Jack, Jack would outrank a hand with a King, Queen, Jack based on a comparison of the highest ranking card in each hand (i.e., an Ace outranks a King). In a further optional embodiment, the hand ranking system may look at additional game pieces in the hands, in turn, until a differentiating game piece is found. Thus, in one such example, a hand consisting of Ace, King, Jack would outrank a hand consisting of Ace, Queen, Queen based on a comparison of the second highest ranking playing card in each hand (i.e., a King outranks a Queen).

In a further optional embodiment, a hand ranking system may additionally take account of whether values of the game pieces in a hand have a relationship with one another. For example, in one such optional embodiment, game pieces with sequential values may be accorded a higher ranking. Thus, in one such example, a three-card straight may outrank three non-consecutive cards. In the examples given below, such a hand ranking is not used in resolving a base bet but may be used in resolving a bonus or side bet. However, it is noted that such a hand ranking may be used in resolving a base bet, a bonus or side bet, or any bet according to an embodiment of the present invention.

Each wager is resolved by evaluating the final player hand associated with the wager. In an optional embodiment conducted using a device, the evaluation of the final player hand(s) may be performed by a data processor.

In an optional embodiment, the final player hand may be compared to a final dealer hand. In one such optional embodiment, a dealer hand is dealt and a final dealer hand if formed from the dealer hand. In a further optional embodiment, as discussed above, it may be required that the final dealer hand meet 110 a qualifying hand ranking, i.e., the final dealer hand must "qualify," for the final player hand to be evaluated against the final dealer hand. For example, in one optional embodiment in which the final dealer hand is formed from a dealer hand containing seven conventional playing cards, a final dealer hand may be required to have at least three playing cards from the predefined subset of rank indicia. In alternate optional embodiments, other qualifying hand rankings may be utilized. In an optional embodiment in which a player places an ante wager and a play wager, the failure of the final dealer hand to qualify may lead to a return of the ante wager (i.e., a push) and a payout of even money of the play wager.

In addition to, or as an alternative to, requiring a dealer hand to meet a qualifying ranking, the dealer hand may be dealt a greater quantity of playing cards than the player hand, which provides an advantage to the house in forming the final dealer hand. For example, the final dealer hand may be formed from an eight-card dealer hand, while the final player hand may be formed from a seven-card player hand.

Yet another alternative, or addition, to requiring a dealer hand to meet a qualifying ranking would be to resolve copy hands (i.e., final player hand and final dealer hands containing cards of exactly the same rankings) in favor of the final dealer hand in some or all circumstances.

In such an optional embodiment, the hand ranking of the final dealer hand may be compared to each final player hand using a defined hand ranking system and the wagers may be resolved 116 by determining whether to issue a reward based on the comparison. As discussed above, in one such example, a final player hand with five ace and/or face cards may outrank a final dealer hand with four ace and/or face cards which leads to a reward to the player based on the ante wager and any play wager. Conversely, a final player hand with a Queen-high set of three ace and/or face cards may be outranked by a final dealer hand with a King-high set of three ace and/or face cards, which results in a loss by the player of the ante wager and any play wager.

In yet a further additional or alternative optional embodiment, multiple different comparisons may be made in evaluating the final player hand. For example, separate wagers may be received for evaluation of a final player hand against a pay table. In this manner, a single player hand could, at the player's election, be the subject of multiple wagers resolved in different ways.

For example, in one example utilizing playing cards rank indicia, an embodiment of a method includes receiving wagers from players and dealing a seven-card player hand to each player and a seven-card dealer hand. As noted above, this should be viewed merely as illustrative, since any game piece, or electronic representation thereof, may be used to conduct the method.

Each player forms a final hand to compare against a final dealer hand according to a hand ranking system. In an optional embodiment, the hand ranking system may rank hands according to the quantity of cards from a predefined subset of rank indicia consisting of aces, kings, queens, and jacks. When two hands have an equal number of playing cards from the predefined subset, the rank of the highest card(s) in the hand determines the higher ranking hand. If it is determined that the hands are "copy" hands, that is, the hands have exactly the same ranking cards, a tie may occur. In various optional embodiments, ties may be: (a) resolved in favor of the final dealer hand; (b) resolved in favor of the final player hand; or (c) resolved as a push. In an optional embodiment, the subset of rank indicia may be defined to include, in descending order, Ace, King, Queen, and Jack. As noted above, in a further optional embodiment, the subset of rank indicia may be defined to include, in descending order, Ace, King, Queen, Jack, and ten.

Figure 2:
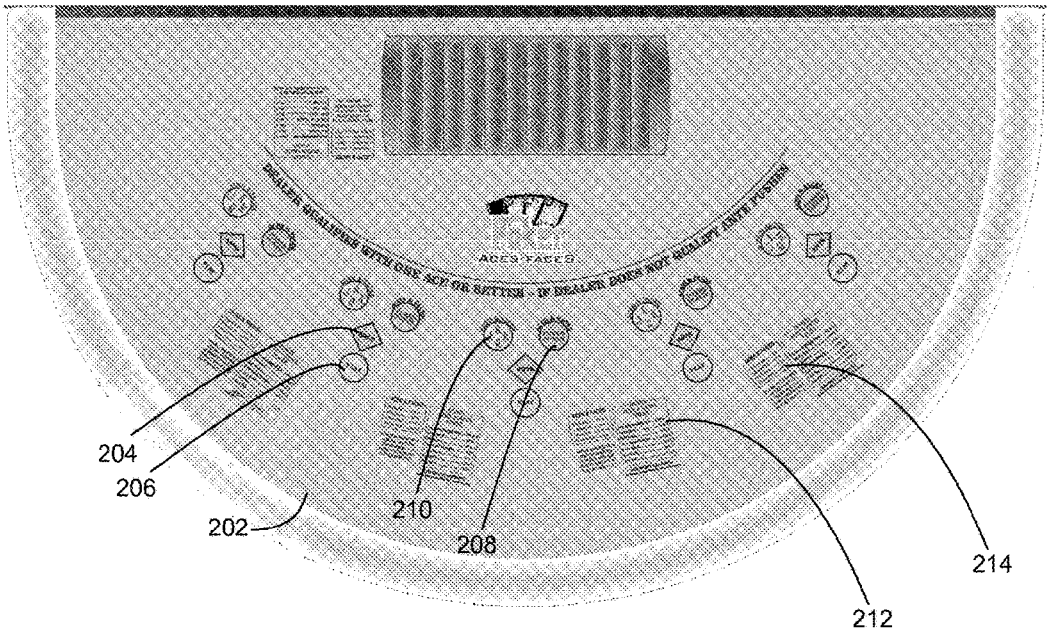
FIG. 2 is a top view of a table layout according to an embodiment of the present invention.

In the following example, a hand ranking system using a subset including Ace, King, Queen, and Jack, as described above, is utilized. In one such example, illustrated in FIG. 2, a game is conducted at a live or electronic gaming table, or using an electronic device, that includes a display of a player area 202 with an ante wager betting area 204, a play wager betting area 206, and, optionally, wagering areas for side wagers 208, 210. The side wagers are described in greater detail below, but broadly speaking, the two side wagers illustrated in FIG. 2 must be separately wagered at the beginning of a game and result in a reward to the player if the final player hand is a hand listed on the side wager pay tables 212, 214.

A game may be conducted using a conventional deck of fifty-two cards. Alternatively, the game may be conducted using a different deck constitution, such as a Spanish deck. Before the game starts, each player places the ante bet within the limits set by the house. Players can optionally bet on the side bets.

In one embodiment, every player receives a player hand of seven cards, although it is contemplated that the game may be conducted with any quantity of cards. In a live embodiment, a dealer deals every player seven cards and himself seven cards. In an embodiment conducted using a device, a data processor deals a player hand of seven cards.

Every player inspects his or her player hand and forms a final player hand by collecting the playing cards from the predefined subset of rank indicia. In one optional embodiment, playing cards outside the subset may be discarded. In another optional embodiment, all the playing cards are retained, but only those from the predefined subset of rank indicia are used in forming the final player hand. In an optional embodiment, the player must decide whether to: (a) fold and forfeit his or her ante wager (although in one embodiment, side bets may not be forfeited and may remain in play) or (b) place a play wager and continue play of the game. In one embodiment, the player may elect to place a play wager equal to 1× or 2× the ante wager, at the player's discretion. Where the unused cards are removed from the final player hand, the unused cards and any folded hands may be collected and discarded.

A dealer hand may be dealt, or in embodiment directed to an electronic device, a dealer hand may be revealed or displayed at a display. A final dealer hand is formed from the dealer hand in a similar manner to the formation of the final player hand(s). That is, the playing cards in the dealer hand from the predefined subset of rank indicia are collected to form the final dealer hand, with the cards outside the predefined subset remaining unused or discarded from the dealer hand.

As noted above, in one embodiment, a final dealer hand must qualify to proceed to a comparison to the final player hands. In one optional embodiment, the final dealer hand must have at least three cards from the predefined subset to qualify. In an optional embodiment, when a dealer's does not qualify, the wagers are resolved without comparison between the final player hand and the final dealer hand. In various optional embodiments, the ante wager could be rewarded and the play wager may be returned, the ante wager may be returned and the play wager rewarded, both wagers could be rewarded, or both wagers could be returned.

When the final dealer hand is a qualifying hand, the final dealer hand is compared to each final player hand according to a defined hand ranking system. In one such optional embodiment, a hand ranking system may include: (a) when the quantity of cards from the predefined subset in the final player hand is greater than that of the final dealer hand, the player receives a payout of even money for his play wager and ante wager; (b) when the quantity of cards from the predefined subset in the final player hand equals that of the final dealer hand, the hand with the higher ranking card wins; (c) when the final player hand and the final dealer hand copy, wagers are returned to the player; and (d) when the quantity of cards from the predefined subset in the final player hand is less than that of the final dealer hand, the player's ante wager and play wager are collected. In a further optional embodiment, if the final player hand contains a special holding (e.g., straight, three-of-a-kind, four-of-a-kind, or the like), a pre-determined bonus could be issued based on the ante wager, play wager, or side wager, as described below.

In an optional embodiment, side wagers may be offered. In an optional embodiment, side wagers must be selected and placed before any cards are dealt. In one optional embodiment, one or more side bets may be offered including, but not limited to, a faces and aces side bet (rewarded based on the quantity of cards from the subset consisting of ace cards and face cards in the final player hand) and a player hand side bet (rewarded based on the poker ranking of the player hand or final player hand).

The side wagers are optionally resolved after the final player hands are formed and may utilize all cards dealt to a player hand, only the cards used to form a final player hand, or any combination thereof. In an optional embodiment, the pay outs for side wagers are defined based on the amount wagered on the side wager. Table 1 illustrates an example pay table for a faces and aces side wager.

TABLE 1

| Player's Hand (7 cards) | Payout |
|---|---|
| 7 face and/or ace cards | 1000 to 1 |
| 6 face and/or ace cards | 500 to 1 |
| 5 face and/or ace cards | 75 to 1 |
| 4 face and/or ace cards | 25 to 1 |
| 3 face and/or ace cards | 3 to 1 |
| 0 face and/or ace cards | 3 to 1 |

Table 2 illustrates another optional embodiment of a pay table for a poker side wager.

TABLE 2

| Player's Hand (7 cards) | Payout |
|---|---|
| 4 aces | 500 to 1 |
| 4 of a kind | 200 to 1 |
| 4 card straight flush | 150 to 1 |
| 5 card full house | 100 to 1 |
| 4+ card straight | 25 to 1 |
| 4+ card flush | 20 to 1 |
| 3 of a kind | 10 to 1 |
| 2 pair | 5 to 1 |
| 3 card straight flush or flush | 3 to 1 |
| 1 pair | 1 to 1 |

In one embodiment, the side wager(s) may be limited so that the amount wagered on the side wager is less than, or equal to, the ante wager. It is noted that many other forms of side bets could be offered in addition to, or in place of, the examples of Tables 1 and 2. It is further noted that any of the rewards offered for side bets could be progressive jackpots that are funded by, for example, an allocation of the side wager. The progressive jackpot accrues until the progressive jackpot is awarded, at which time the progressive jackpot is reset to a starting value and begins to accrue again.

Figure 3:
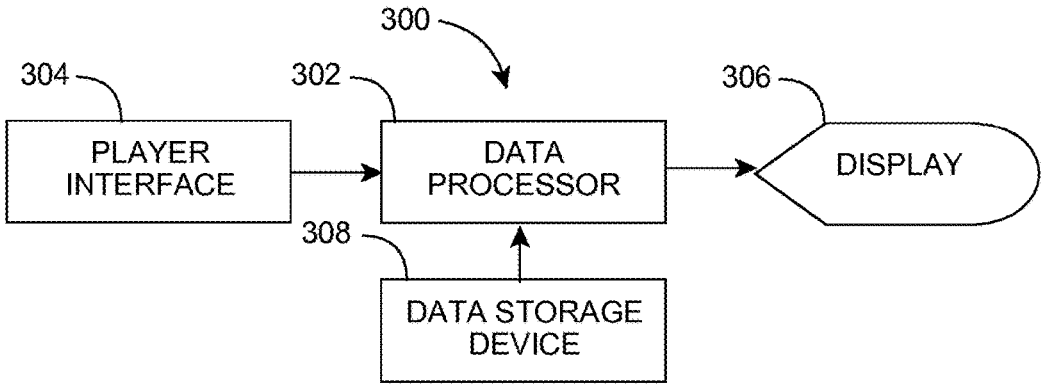
FIG. 3 is a block diagram of a device according to an embodiment of the present invention.

As discussed above and illustrated in FIG. 3, the present method could be implemented on a device 300, such as a cellular telephone, computer network (including, for example, the Internet), personal computer, electronic gaming machine, video card game machine, kiosk, handheld device, tablet, or any other type of device. In an optional embodiment, the device includes a data processor 302 in communication with a data storage device 308 that stores executable program instructions for conducting a method. The data processor 302 also communicates with a display 306 and a player interface 304. In an optional embodiment, the display 306 and player interface 304 may be integrated into a single device such as a touchscreen.

In one such optional embodiment, an ante wager may be placed through a player interface 304. A data processor 302 deals a player hand of game pieces (such as electronic representations of cards) and displays the player hand at the display 306. Optionally, the player may be permitted or required to place a play wager, although this play wager may be omitted in certain optional embodiments.

In one optional embodiment, the data processor 302 selects the final player hand for the player by selecting the greatest quantity of game pieces from the predefined subset of rank indicia from the player hand. In another optional embodiment, the player inputs a selection of a final player hand through the player interface 304. The data processor 302 evaluates the final player hand (optionally by comparing the final player hand to a final dealer hand) and determines whether to issue rewards on the player's wager(s). Optionally, side wagers may be offered and resolved by the data processor 302 if received through the player interface.

While certain embodiments of the present invention have been shown and described it is to be understood that the present invention is subject to many modifications and changes without departing from the spirit and scope of the invention presented herein.

What is claimed is:

1. A method of conducting a wagering game for at least one player at a gaming table having a specially configured playing surface using physical game pieces marked with a plurality of ranked indicia, said method comprising:

defining a subset of ranked indicia for collection, said subset of ranked indicia including one or more, but not all, of said plurality of ranked indicia marking said physical game pieces;

receiving an ante wager at an ante wager location defined by said playing surface comprising receiving at said ante wager location one or more physical items having associated monetary value;

dealing onto said playing surface of said gaming table a player hand of game pieces in response to receipt of said ante wager;

forming a final player hand comprising only the game pieces in said player hand marked with ranked indicia within said predefined subset of ranked indicia by excluding game pieces from said player hand that are not marked with ranked indicia within said predefined subset of ranked indicia;

conducting a first evaluation of said final player hand based only on the quantity of game pieces in said final player hand; and determining whether to issue a payout based on the evaluation of said final player hand.

2. The method of claim 1 wherein said game pieces are playing cards and said ranked indicia comprise playing card values 2, 3, 4, 5, 6, 7, 8, 9, 10, Jack, Queen, King and Ace.

3. The method of claim 1 further comprising:

receiving an election to fold and surrender said ante wager or place a play wager at a play wager location defined by said playing surface comprising receiving at said play wager location one or more physical items having associated monetary value; and forming a final player hand when said election was received to place a play wager.

4. The method of claim 1 further comprising:

dealing onto said playing surface at said gaming table a dealer hand; and forming a final dealer hand using only game pieces in said dealer hand marked with ranked indicia within said predefined subset of ranked indicia by excluding game pieces from said dealer hand that are not marked with ranked indicia within said predefined subset of ranked indicia, wherein said first evaluation comprises comparing the quantity of game pieces in said final player hand to a quantity of game pieces in said final dealer hand, and said step of determining comprises issuing a payout for said final player hand when said final player hand has a greater quantity of game pieces than said final dealer hand and collecting at least said ante wager for said final player hand when said final player hand has a lesser quantity of game pieces than said final dealer hand.

5. The method of claim 4 further comprising conducting a second evaluation comparing the ranked indicia of the playing cards in said final dealer hand and said final player hand when said final player hand and said final dealer hand contain an equal quantity of game pieces.

6. The method of claim 2, wherein the playing card values within the subset of ranked indicia comprise the 10, ace, jack, queen, and king.

7. The method of claim 5, wherein the final player hand is determined to be a winning hand when a highest ranking game piece of the final player hand is of a higher rank than a highest ranking game piece of the final dealer hand.

8. The method of claim 4, further comprising determining whether said final dealer hand is a qualifying hand, the qualifying hand being based on a number of game pieces forming the final dealer hand, wherein said payout depends on said dealer hand being the qualifying hand.

9. The method of claim 8, wherein the number of game pieces forming the qualifying hand is three or more.

10. The method of claim 8, wherein the ante wager is returned when the final dealer hand is not the qualifying hand.

11. The method of claim 1 further comprising:

defining a pay table of hand rankings associated with payouts, wherein said first evaluation comprises comparing said final player hand to said pay table, and said step of determining comprises issuing the pay out, if any, associated with the hand ranking of said final player hand according to said pay table.

12. The method of claim 1 further comprising:

defining a side wager pay table of hand rankings and associated pay outs;

receiving a side wager at a side wager location defined by said playing surface from at least one player prior to dealing said player hand; and resolving said side wager by comparing said final player hand to said side wager pay table and issuing the pay out, if any, associated with said final player hand.

13. A method of conducting a wagering game for at least one player at a gaming table having a specially configured playing surface and using physical game pieces marked with a plurality of ranked, comprising the steps of:

receiving an ante wager at an ante wager location defined by said playing surface comprising receiving at said ante wager location one or more physical items having associated monetary value;

dealing onto said playing surface a player hand of game pieces in response to receipt of said ante wager;

receiving an election from said player to fold and surrender said ante wager or place a play wager at a play wager location defined by said playing surface comprising receiving at said play wager location one or more physical items having associated monetary value;

forming a final player hand upon the election to place a play wager, wherein said final player hand is formed comprising only the game pieces in said player hand marked with ranked indicia from a predefined subset of rank indicia which comprises at least one, but not all, of said ranked indicia, by excluding game pieces from said player hand that are not marked with ranked indicia within said predefined subset of ranked indicia;

conducting a first evaluation of said final player hand based only on the quantity of game pieces in said final player hand; and determining whether to issue a pay out by said data processor based on the evaluation of said final player hand.

14. The method of claim 13 wherein said game pieces are playing cards and said ranked indicia are playing card values.

15. The method of claim 13 further comprising:

dealing onto said playing surface of said gaming table a dealer hand; and forming a final dealer hand using only game pieces in said dealer hand marked with ranked indicia within said predefined subset of rank indicia by excluding game pieces from said dealer hand that are not marked with ranked indicia within said predefined subset of ranked indicia, wherein said first evaluation comprises comparing the quantity of game pieces in said final player hand to a quantity of game pieces in said final dealer hand, and said step of determining comprises issuing a payout for said final player hand when said final player hand contains a greater quantity of game pieces than said final dealer hand and collecting at least said ante wager for said final player hand when said final player hand contains a lesser quantity of game pieces than said final dealer hand.

16. The method of claim 15 further comprising conducting a second evaluation comparing the ranked indicia of the game pieces in said final dealer hand and said final player hand when said final player hand and said final dealer hand contain an equal quantity of playing cards.

17. The method of claim 13 further comprising:

defining a pay table of hand rankings associated with pay outs, wherein said first evaluation comprises comparing said final player hand to said pay table, and said step of determining comprises issuing the pay out, if any, associated with the hand ranking of said final player hand according to said pay table.

18. The method of claim 14 further comprising:

defining a side wager pay table of hand rankings and associated pay outs;

receiving a side wager at a side wager location defined by said playing surface from at least one player prior to dealing said player hand; and resolving said side wager by comparing said final player hand to said side wager pay table and issuing the pay out, if any, associated with said final player hand.

* * * * *